United States Patent [19]

Wallace

[11] 4,350,341

[45] Sep. 21, 1982

[54] SURFACE COVERING TILES

[76] Inventor: John Wallace, 359 Nassau St., Princeton, N.J. 08540

[21] Appl. No.: 274,823

[22] Filed: Jun. 18, 1981

[51] Int. Cl.[3] ..... A63F 9/10

[52] U.S. Cl. ..... 273/157 R; 52/311; 434/211

[58] Field of Search ..... 273/157 R; 52/311; 428/33, 44; 434/211, 81

[56] References Cited

U.S. PATENT DOCUMENTS 4,052,074 10/1977 Fogle et al. ..... 273/157 R
4,133,152 1/1979 Penrose ..... 273/157 R X

FOREIGN PATENT DOCUMENTS 43542 12/1930 Denmark ..... 434/81
2161673 6/1973 Fed. Rep. of Germany ..... 434/211
WO80/1990 10/1980 PCT Int'l Appl. ..... 273/157 R

OTHER PUBLICATIONS

Mathematics Teacher, "Transformation Geometry and the Artwork of M. C. Escher" by Sheila Haak, Dec. 1976, pp. 647–652.

Scientific American, "Mathematical Games" by Martin Gardner, Jan. 1977, pp. 110–112, 115–121.

*Primary Examiner*—Anton O. Oechsle

*Attorney, Agent, or Firm*—Omri M. Behr

[57] ABSTRACT a plurality of identically shaped tiles having an odd number of sides may be used to form a periodic or non-periodic pattern when covering a plane surface.

8 Claims, 13 Drawing Figures

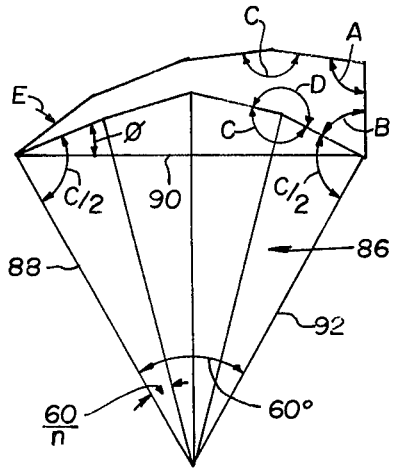
FIGURE 7
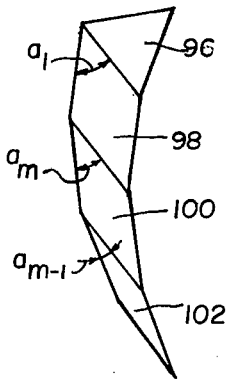
FIGURE 8
| m \ n | 1 | 2 | 3 | 4 | 5 |
|---|---|---|---|---|---|
| 1 | 0° | 30° | 40° | 45° | 48° |
| 2 | - | 0° | 20° | 30° | 36° |
| 3 | - | - | 0° | 15° | 24° |
| 4 | - | - | - | 0° | 12° |
| 5 | - | - | - | - | 0° |
| 6 | – | – | – | – | – |
| 7 | – | – | – | – | – |
FIGURE 9

SURFACE COVERING TILES

BACKGROUND OF THE INVENTION

1. Field of the Invention

The present invention relates to tiles for covering a plane surface, and more particularly, to the field of geometry known as tessellation, which has been defined as the covering of prescribed areas with tiles of prescribed shapes. Practical applications of this field include the design of paving and of wall-coverings, educational toys and games, and artistic creations which have esthetic appeal to the beholder 2. Discussion of the Relevant Art In the general field of tessellation, symmetry obviously plays an important part. The simplest and best-known form of tessellation is the jig-saw puzzle, in which a very simple shape, such as a rectangle or a circle, is covered with a multitude of pieces of irregular shapes and may have indicia thereon in the form of a design or picture. The characteristic of a jig-saw puzzle is the fact that it is designed to be assembled in a particular manner in order to be able to recover a complete picture from the various portions that have been placed on each of the individual pieces. A recent form of tessellation is disclosed in U.S. Pat. No. 4,133,152 to Penrose. The tiles of Penrose are generally composed of two types. Each type is basically quadrilateral in shape and the respective shapes are such that if a multiplicity of tiles are juxtaposed in a matching configuration, which may be prescribed by matching markings or shapings, the pattern which they form is necessarily non-repetitive (non-periodic), giving a considerable esthetic appeal in the eye of the beholder.

More sophisticated forms of tessellation have utilized identical pieces which may be arranged to form a variety of shapes, such as so-called polyominoes. One of these tessellation arrangements is disclosed in U.S. Pat. No. 4,223,890 to Schoen which issued on Sept. 23, 1980, which discloses the use of a set of tiles composed of distinct pieces which can be arranged in a variety of ways to form the identical regular polygon having an even number of sides. While the set may be constructed relatively easily, the number of ways in which the regular polygon may be formed therefrom increases rapidly for increasing numbers of sides of the polygon. Sets of tiles according to the invention may be used to constrct different puzzles; each having widely differing complexity. The tiles may also be adapted to be used as a game, for educational purposes, and in the arrangement of esthetic designs.

The present invention differs from all tessellation schemes known in the prior art, in that the tiles are preferably identical in shape and may be juxtaposed to cover a plane surface while creating a periodic or non-periodic design. Utilizing different types of indicia on the tiles permits numerous varying effects to be accomplished which are appealing to the beholder. With modification of the conventional straight line side the tiles may be made to form fish or fowl and combined in any determined proportion to create a further striking affect. The number of sides utilized in the construction of a tile is always an odd integer and may be any number greater than 5.

SUMMARY OF THE INVENTION

The tiles disclosed in the present invention have an odd number of sides, may have indicia placed thereon to create varying esthetic effects, may have modifications made to each of the sides to create different unique designs, and may form periodic or non-periodic designs in accordance with the arranger of the tiles when placing them juxtaposed on a flat surface.

According to the principles of the present invention, a plurality of identically shaped tiles for covering a plane surface in a periodic or non-periodic manner, with each tile comprising a polygon having a plurality of sides of equal length, the number of sides (S) being determined from the equation $S=2n+1$, where n is an integer greater than 1. The angle A in degrees formed between a reference side and a first side is determined by, $A=120-60/n$. The angle B formed between the reference side and the second side is equal to 60 degrees. Each of the angles C in degrees formed between the first side and successive sides adjacent thereto is determined by $C=180-60/n$. The angles D in degrees formed between the second side and successive sides adjacent thereto is determined by $D=180+60/n$. The closing angle E in degrees between the last successive first and second sides is given by $E=60/n$.

In addition, according to the principles of the present invention, the plurality of identically shaped tiles for covering a plane surface in a periodic or non-periodic manner may be found to comprise; a polygon having a plurality of sides of equal length, the number of sides (S) determined from the equation $S=2n+1$, where n is an integer greater than 1. The polygon includes one equilateral triangle and at least one diamond juxtaposed along one edge of said triangle. Additional diamonds are juxtaposed along the opposite edge of the preceding diamond. The acute angle of one of the diamonds is adjacent to the obtuse angle of the other of the diamonds. The sides of each of the diamonds are equal to the other and to the sides of the equilateral triangle. The number of diamonds (N) is given by the equation $N=n-1$. The acute angle ($a_m$) in degrees for diamond $d_m$ is given by the equation $a_m=60(1-m/n)$. The acute angle ($a_{n-1}$) in degrees of the Nth diamond is given by $a_{n-1}=60/n$.

The foregoing advantages of the instant invention will become apparent from the description to follow. In the description reference is made to the accompanying drawing which forms a part hereof, and in which is shown by way of illustration, a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which;

FIG. 7 is a pictorial representation showing the construction of a nine-sided tile;

FIG. 8 shows an alternative means of delineating a nine-sided tile; and

FIG. 9 is a chart which indicates the value of the acute angle of each of the diamonds depending upon their position and the number of sides selected for the polygon.

DESCRIPTION OF THE PREFERRED EMBODIMENTS

Figure 1:
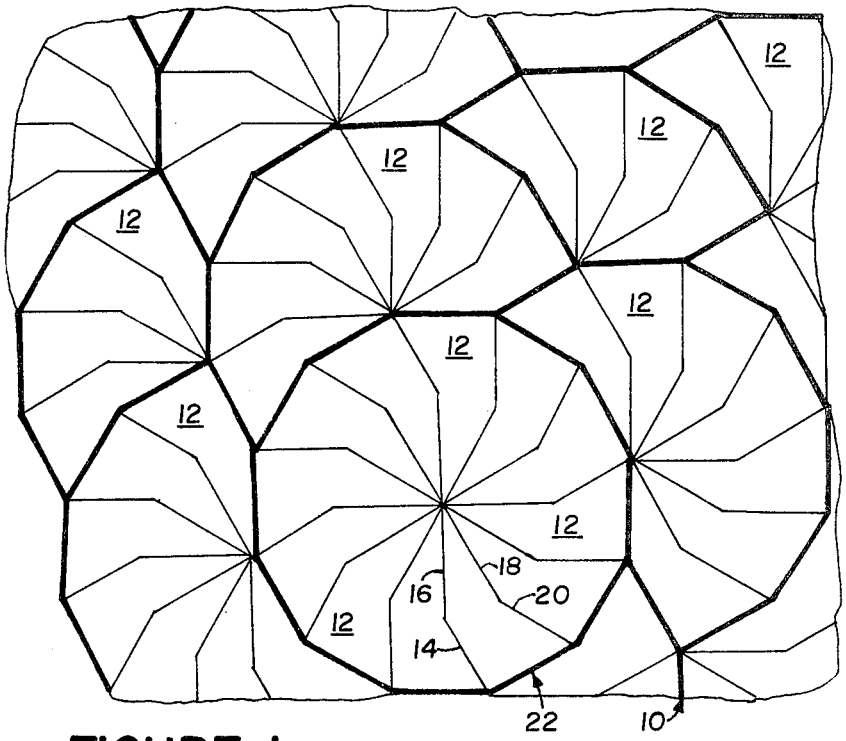
FIG. 1 shows a section of an assembly of five-sided tiles having indicia along one edge thereof creating a periodic and/or non-periodic design.

Referring now to the figures, and in particular to FIG. 1 which shows a section 10 of an assembly of five-sided tiles 12 which have been arranged to form either periodic or non-periodic designs. The tiles 12, as shown in FIG. 1 contain five sides 14, 16, 18, 20 and 22. As shown, the margin 24 juxtaposed side 22 has been provided with indicia which, as presently shown, is a band of solid color which makes the design configuration more readily apparent to the viewer and is capable of creating pleasing designs to the viewer. The band of indicia 24 may be varied in accordance with any color or configuration desired and by varying the edge upon which the indicia has been placed, will cause different design effects to be accomplished. Placing the groups of tiles 12 in different positions can provide a plurality of designs each one being different (non-periodic) or forming some form of duplication which may be deemed periodic. Each of the sides 14, 16, 18, 20 and 22 are equal to each other and the angle appearing between any pair of sides is clearly specified hereinafter in order to enable one skilled in the art to construct the tiles disclosed herein. The number of sides is determined by selecting an integer greater than 1 and constructing the tile as described hereinafter. As shown in FIG. 1, the sides of the tiles are straight edges or lines. These lines may be modified and different design results will be obtained.

Figure 2:
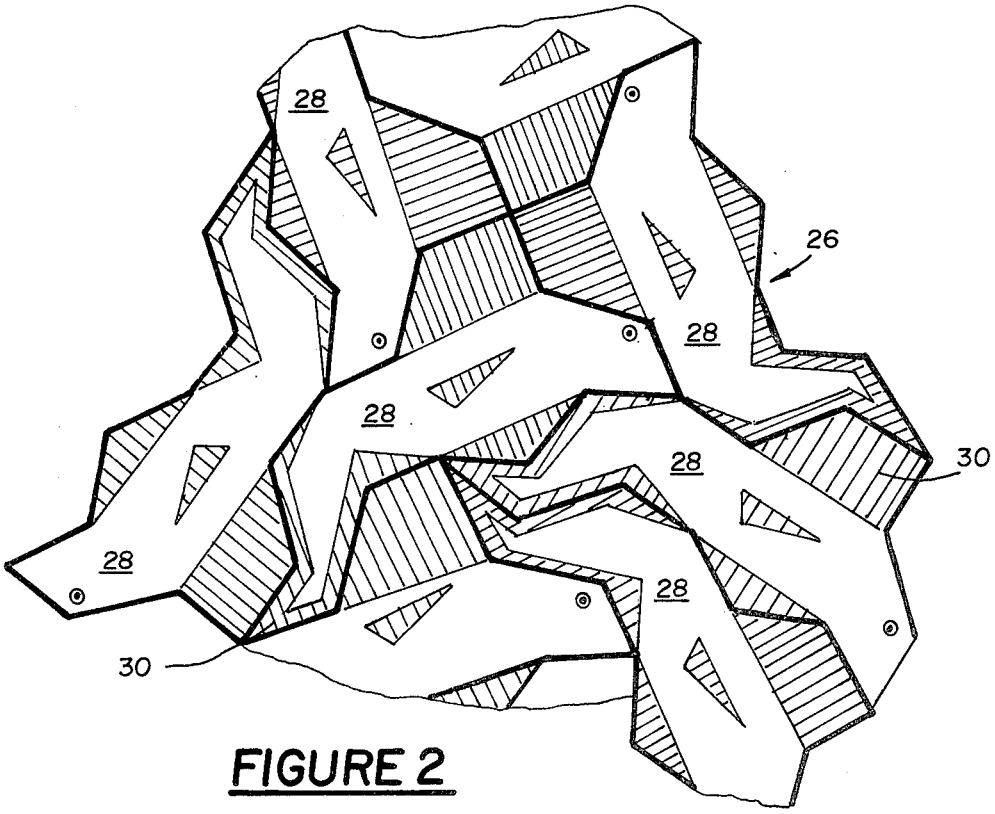
FIG. 2 shows a section of an assembly of tiles which have been modified and provide a non-periodic design.

Referring now to FIG. 2 which discloses a section 26 of an assembly of modified tiles 28, each identical to each other, and modified, as will be explained hereinafter, and includes indicia 30 thereon creating the general appearance of a fish. When the tiles 28 are assembled to cover a flat surface it becomes apparent that a non-periodic design having esthetic appeal is created in a manner similar to that disclosed in FIG. 1. The uniqueness of the design varies with the assembler's desire and is practically unlimited. Here again, these tiles may be modified along the sides, as will be explained hereinafter, with certain constraints which will be set forth, but the variations, again, are unlimited and is left to the imagination of the creator of the design. The modified tile 28 shown in FIG. 2 was created from the basic five-sided tile 12 shown in FIG. 1.

It is to be noted that an unmodified tile such as that shown in FIG. 1 may be inverted or turned over and integrated into the overall covering of the plane surface such as a wall or floor. However, once a tile has been modified as the tile 28 has been, it may not be inverted or turned over and be integrated into a uniform plane covering with the other tiles.

Figure 3:
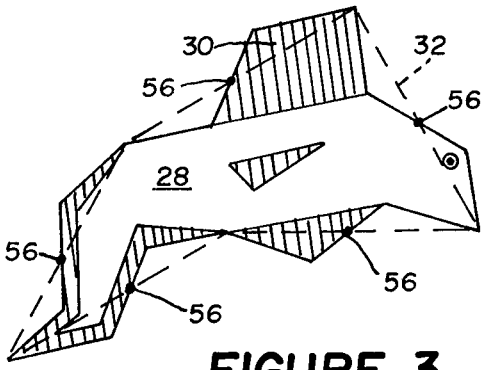
FIG. 3 shows a five-sided tile that has been modified on each of the sides and includes indicia thereon to suggest a fish.

Referring now to FIG. 3 which discloses a five-sided tile 28 that has been modified along each of its sides and provided with indicia thereon to create the suggestion of a fish. The basic tile configuration is shown as a broken line 32 and may be seen to be a five-sided polygon of the type described in conjunction with FIG. 1.

Figure 4:
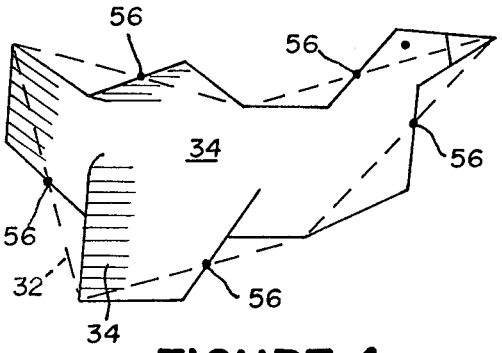
FIG. 4 shows a five-sided tile having each side modified and indicia placed thereon to suggest a fowl.

Referring now to FIG. 4, the basic five-sided tile is shown in the broken line 32. Each of the sides have been modified in accordance with the procedure described hereinafter and indicia 34 has been placed on the surface of the tile to create the appearance of a fowl or bird in flight. The modified tile 34 is identical to the tile 28 as far as the physical construction (sides) is concerned. However, the indicia placed thereon creates an entirely different appearance.

Figure 5:
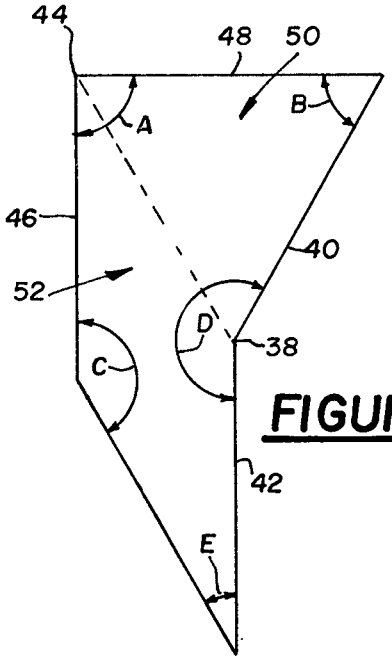
FIG. 5 shows a basic five-sided tile which is modified to provide the embodiments disclosed in FIGS. 3 and 4.

Referring now to FIG. 5 which shows the basic tile configuration 32 for a five-sided polygon where each side is equal to every other side. By simple geometric construction it becomes obvious that utilizing a broken line 36 to connect the juncture 38 of sides 40 and 42 with the juncture 44 of sides 46 and 48, there is formed; an equilateral triangle 50 and a diamond 52. It can be seen by observation that since sides 36, 40 and 48 form an equilateral triangle each of the angles therein are equal and total 180 degrees, thereby, having angle B equal 60 degrees. Angle B will always be 60 degrees regardless of the number of sides forming the tile or the numeral selected for n, as will be explained hereinafter. By construction and/or observation it can be shown that the angle A will equal 60 degrees plus the 30 degrees of A which is the acute angle of the diamond 52. Since the diamond 52 is a parallelogram the angle E is also 30 degrees and since the total sum of the number of degrees for a parallelogram equals 360 degrees, angle C must be equal to 300 degrees times $\frac{1}{2}$ or 150 degrees. Angle D is equal to the parallelogram angle of 150 degrees plus the equilateral triangle angle of 60 degrees, or 210 degrees.

Figure 6A:
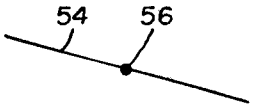
FIG. 6 (*a*) through (*e*) shows alternative modifications and restrictions to these modifications that may be made on each of the sides of a basic tile.

Referring now to FIG. 6*a* which shows a conventional side 54 of a polygon utilized in the instant invention prior to modification. The center point or axis 56 is noted on line 54 and any modification made to the side must conform or be limited by the restriction that any modifications which deviate from the straight line must be made so that when one-half of the modified line is rotated about the axis 56 through 180 degrees, the modifications made to the other half of the line will coincide therewith. Or, in other words, the modification to the straight line must be made to be symmetrical through a rotation of 180 degrees about the central axis 56.

Figure 6B:
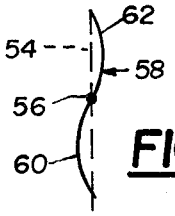
Figure 6C:
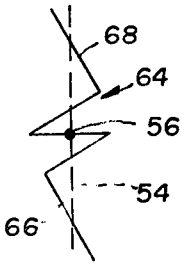

Referring now to FIG. 6*b* the polygon side 54 is shown in the broken line and the modification to the straight line side is shown as a curved portion 58 generally resembling a sine wave. When rotating one-half of the curved portion through 180 degrees about the center point or axis 56 it can be seen that the curved portion 60 will coincide with the curved portion 62. For another example, reference may be made to FIG. 6*c* wherein the broken line 54 represents the unmodified or straight line which coincides with the side of the polygon and 56 represents the axis of rotation or symmetry of the modified side 64. When portion 66 of the side 64 is rotated about the axis 56 180 degrees, it can be seen that it will coincide with the portion 68 of the modified side 64, thereby, indicating that the modification to the straight line side 54 conforms with the restrictions placed thereon, according to the principles of the present invention.

Figure 6D:
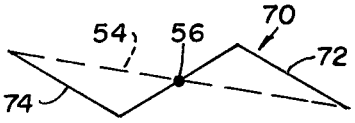
Figure 6E:
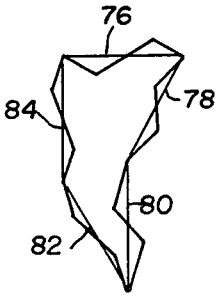

A further example of modifying a straight line side 54 is shown in FIG. 6*d* wherein modified side 70 may be shown to meet the restriction criteria by having one-half of the modified side portion 72 rotated about the axis 56 through 180 degrees to coincide with the portion 74 of the modified side 70. A modification of all the sides of a five sided polygon, in accordance with the principles of the instant invention is shown in FIG. 6*e*. The straight edges of the tiles are shown as 76, 78, 80 82 and 84, all of which have been modified in accordance with the criteria set forth above.

Referring back to FIGS. 3 and 4, it now becomes readily apparent that the rotation point or axis 56 for each of the modified sides is shown by the enlarged black dot provided at the center of the broken lines which indicate the original polygon unmodified sides. With the addition of various kinds of indicia thereon, a multitude of effects can be created.

Referring now to FIG. 7 wherein the physical construction of a tile having nine sides has been illustrated. The construction starts by utilizing an equilateral triangle 86 having three equal sides 88, 90 and 92. If it is desired to construct a tile having nine sides, therefore, by inspection, it becomes obvious that the number of sides S is given the equation $S=2n+1$, wherein n is the number of times the angle formed between sides 88 and 92 is to be divided and may be any integer greater than 1. Thus, for an integer of 4 selected for n, the number of sides of the tile would equal 9. Since we started with an equilateral triangle, the angle C may be calculated as follows, knowing that the sum of the angles of an equilateral triangle must equal 180 degrees; therefore:

$$C+60/n=180$$

$$C=180-60/n;\text{ in degrees.}$$

It is also to be noted that angles $C+D=360$ degrees. Therefore, angle $$D=360-(180-60/n)$$

$$D=180+60/n;\text{ in degrees.}$$

The angle $$\phi=C/2-60$$

$$\phi=90-30/n-60$$

$$\phi=30(1-1/n).$$

And, by definition, the angle $E=60/n$; in degrees.

Since the tiles are actually formed by constructing a group of isosceles triangles and then rotating the broken line formed by their bases through an angle of 60/n degrees and joining the end points of the line occurring at the distal end away from angle E forming the completed polygon.

It also can be shown that $2\phi+60=A$; in degrees. Therefore, $$A=60+60(1-1/n)$$

$$A=120-60/n;\text{ in degrees.}$$

And the angle B, is given by $$B=C/2-\phi$$

$$B=90-30/n-30(1-1/n);\text{ or}$$

$$B=60\text{ degrees.}$$

It is also obvious that all of the angles C are equal and all of the angles D are equal since all the sides of the tiles are equal.

Utilizing another approach to the construction of the tiles, it may be shown (FIG. 8) that dividing the tile into an equilateral triangle 96 and a plurality of diamonds 98, 100 and 102 the following becomes apparent:

The number of diamonds N is given by the equation:

$$N=n=1.$$

For the diamond $d_m$, the acute angle ($a_m$) is given by:

$$a_m=60(1-m/n);\text{ in degrees and}$$

$$a_{m-1}=60(1-n-1/n)=60/n;\text{ in degrees.}$$

The nth diamond has an angle $a_n=0$ degrees therefore, it doesn't exist, and when $n=1$, the tile is just an equilateral triangle. Thus, solving the above equations for $n=1$ through 5 and $m=1$ through 7, the table shown in FIG. 9 may be constructed. The table in FIG. 9 discloses the acute angle of each diamond depending on the position of the diamond and the number chosen for n. Here, as stated earlier, all of the sides of the tile are equal to each other.

Hereinbefore, has been disclosed a unique tile having an odd number of sides which may be modified and include indicia thereon to create the appearance of a fish or fowl and is capable of providing periodic and non-periodic designs having esthetic appearance to the beholder. It will be understood that various changes in details, arrangement of parts and operating conditions which have been herein described and illustrated in order to explain the nature of the invention may be made by those skilled in the art within the principles and scope of the instant invention.

Having thus set forth the nature of the invention what is claimed is:

1. A plurality of identically shaped tiles for covering a plane surface in a periodic or non-periodic manner, each said tile comprising:

(a) a polygon having a plurality of sides of equal length, the number of sides (S) being determined from the equation, $S=2n+1$; where n is an integer greater than 1;

(b) the angle (A) in degrees formed between a reference side and a first side being determined by, $A=120-60/n$;

(c) the angle (B) formed between said reference side and a second side being equal to 60 degrees;

(d) each of the angles (C) in degrees formed between said first side and successive sides being adjacent thereto being determined by, $C=180-60/n$;

(e) the angles (D) in degrees formed between said second side and successive slide being adjacent thereto being determined by, $D=180+60/n$; and (f) the closing angle (E) in degrees between the last successive first and second sides being given by, $E=60n$.

2. A plurality of identically shaped tiles for covering a plane surface in a periodic or non-periodic manner, each said tile comprising:

(a) a polygon having a plurality of sides of equal length, the number of sides (S) being determined from the equation, $S=2n+1$, where n is an integer greater than 1, said polygon including one equilateral triangle and at least one diamond juxtaposed along one edge of said triangle, additional diamonds being juxtaposed along the opposite edge of said preceding diamond, the acute angle of one of said diamonds being adjacent the obtuse angle of the other of said diamonds, the sides of each said diamond being equal to each other and to the sides of said equilateral triangle;

(b) the number of diamonds (N) being given by the equation, $N=n-1$;

(c) the acute angle ($a_m$) in degrees for diamond ($d_m$) being given by the equation, $a_m=60(1-m/n)$; and (d) the acute angle ($a_{n-1}$) in degrees of the Nth diamond being given by, $a_{n-1}=60/n$.

3. A plurality of identically shaped tiles according to claim 1 or 2 wherein each said tile has indicia thereon for forming a periodic or non-periodic design.

4. A plurality of identically shaped tiles according to claim 1 or 2 wherein one or more of said sides are modified from a straight line and made to be symmetrical through a rotation of 180 degrees about the central axis of said side.

5. A plurality of identically shaped tiles according to claim 4 wherein said tile sides are modified and said tiles include indicia thereon to suggest a fish.

6. A plurality of identically shaped tiles according to claim 4 wherein said tile sides are modified and said tiles include indicia thereon to suggest a fowl.

7. A plurality of identically shaped tiles according to claim 4 wherein said tile sides are modified and a predetermined number of said tiles include indicia thereon to suggest a fish and a predetermined number of said tiles suggest a fowl, said fish and fowl tiles being integrated to cover said plane surface.

8. A plurality of identically shaped tiles according to claim 1 or 2 wherein one or more of said tiles may be turned over and integrated into said surface covering.

* * * * *